US007195497B2

(12) United States Patent
Hull et al.

(10) Patent No.: US 7,195,497 B2
(45) Date of Patent: Mar. 27, 2007

(54) RETENTION MEMBER FOR CONNECTOR SYSTEM

(75) Inventors: Gregory A. Hull, York, PA (US); Stuart C. Stoner, Lewisberry, PA (US); Steven E. Minich, York, PA (US); Alan Raistrick, Rockville, MD (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/278,849

(22) Filed: Apr. 6, 2006

(65) Prior Publication Data

US 2006/0166528 A1 Jul. 27, 2006

Related U.S. Application Data

(63) Continuation of application No. 10/842,397, filed on May 10, 2004, now Pat. No. 7,083,432.

(60) Provisional application No. 60/492,901, filed on Aug. 6, 2003.

(51) Int. Cl.
*H01R 12/00* (2006.01)

(52) U.S. Cl. ..... 439/79

(58) Field of Classification Search ..... 439/79, 439/608, 80, 81
See application file for complete search history.

(56) References Cited

U.S. PATENT DOCUMENTS

| | | | | |
|---|---|---|---|---|
| 3,669,054 | A | 6/1972 | Desso et al. | 113/119 |
| 3,748,633 | A | 7/1973 | Lundergan | 339/217 S |
| 4,076,362 | A | 2/1978 | Ichimura | 339/75 |
| 4,159,861 | A | 7/1979 | Anhalt | 339/75 |
| 4,260,212 | A | 4/1981 | Ritchie et al. | 339/97 R |
| 4,288,139 | A | 9/1981 | Cobaugh et al. | 339/74 R |
| 4,402,563 | A | 9/1983 | Sinclair | 339/75 |
| 4,560,222 | A | 12/1985 | Dambach | 339/75 |
| 4,717,360 | A | 1/1988 | Czaja | 439/710 |
| 4,776,803 | A | 10/1988 | Pretchel et al. | 439/59 |
| 4,815,987 | A | 3/1989 | Kawano et al. | 439/263 |
| 4,867,713 | A | 9/1989 | Ozu et al. | 439/833 |
| 4,907,990 | A | 3/1990 | Bertho et al. | 439/851 |
| 4,973,271 | A | 11/1990 | Ishizuka et al. | 439/839 |
| 5,077,893 | A | 1/1992 | Mosquera et al. | 29/882 |
| 5,174,770 | A | 12/1992 | Sasaki et al. | 439/108 |
| 5,238,414 | A | 8/1993 | Yaegashi et al. | 439/108 |
| 5,274,918 | A | 1/1994 | Reed | 29/882 |
| 5,590,463 | A | 1/1997 | Feldman et al. | 29/844 |
| 5,609,502 | A | 3/1997 | Thumma | 439/747 |

(Continued)

FOREIGN PATENT DOCUMENTS

EP 0 273 683 A2 7/1988

(Continued)

*Primary Examiner*—Phuong Dinh
(74) *Attorney, Agent, or Firm*—Woodcock Washburn LLP

(57) ABSTRACT

A retention member aligns and stabilizes one or more insert molded lead assemblies (IMLAs) in an electrical connector. The retention member provides for alignment and stability in the x-, y-, and z-directions. Such a retention member may be in connection with a right angle header connector. The retention member provides stability by maintaining the true positioning of the terminal ends of the contacts. The retention member is expandable in length, and may be sized and shaped to fit a single header assembly or multiple position configurations.

25 Claims, 9 Drawing Sheets

U.S. PATENT DOCUMENTS

| | | | | |
|---|---|---|---|---|
| 5,672,064 | A | 9/1997 | Provencher et al. | 439/79 |
| 5,730,609 | A | 3/1998 | Harwath | 439/108 |
| 5,741,144 | A | 4/1998 | Elco et al. | 439/101 |
| 5,741,161 | A | 4/1998 | Cahaly et al. | 439/709 |
| 5,795,191 | A | 8/1998 | Preputnick et al. | 439/608 |
| 5,817,973 | A | 10/1998 | Elco et al. | 174/32 |
| 5,860,816 | A | 1/1999 | Provencher et al. | 439/79 |
| 5,908,333 | A | 6/1999 | Perino et al. | 439/631 |
| 5,961,355 | A | 10/1999 | Morlion et al. | 439/686 |
| 5,980,321 | A | 11/1999 | Cohen et al. | 439/608 |
| 5,993,259 | A | 11/1999 | Stokoe et al. | 439/608 |
| 6,068,520 | A | 5/2000 | Winings et al. | 439/676 |
| 6,123,554 | A | 9/2000 | Ortega et al. | 439/79 |
| 6,125,535 | A | 10/2000 | Chiou et al. | 29/883 |
| 6,139,336 | A | 10/2000 | Olson | 439/83 |
| 6,146,157 | A | 11/2000 | Lenoir et al. | 439/101 |
| 6,146,202 | A | 11/2000 | Ramey et al. | 439/608 |
| 6,146,203 | A | 11/2000 | Elco et al. | 439/609 |
| 6,190,213 | B1 | 2/2001 | Reichart et al. | 439/736 |
| 6,212,755 | B1 | 4/2001 | Shimada et al. | 29/527.1 |
| 6,219,913 | B1 | 4/2001 | Uchiyama | 29/883 |
| 6,220,896 | B1 | 4/2001 | Bertoncini et al. | 439/608 |
| 6,267,604 | B1 * | 7/2001 | Mickievicz et al. | 439/79 |
| 6,269,539 | B1 | 8/2001 | Takahashi et al. | 29/883 |
| 6,293,827 | B1 | 9/2001 | Stokoe et al. | 439/608 |
| 6,319,075 | B1 | 11/2001 | Clark et al. | 439/825 |
| 6,328,602 | B1 | 12/2001 | Yamasaki et al. | 439/608 |
| 6,347,952 | B1 | 2/2002 | Hasegawa et al. | 439/608 |
| 6,350,134 | B1 | 2/2002 | Fogg et al. | 439/79 |
| 6,363,607 | B1 | 4/2002 | Chen et al. | 29/883 |
| 6,371,773 | B1 | 4/2002 | Crofoot et al. | 439/79 |
| 6,379,188 | B1 | 4/2002 | Cohen et al. | 439/608 |
| 6,409,543 | B1 | 6/2002 | Astbury, Jr. et al. | 439/608 |
| 6,431,914 | B1 | 8/2002 | Billman | 439/608 |
| 6,435,914 | B1 | 8/2002 | Billman | 439/608 |
| 6,461,202 | B2 | 10/2002 | Kline | 439/701 |
| 6,471,548 | B2 | 10/2002 | Bertoncini et al. | 439/608 |
| 6,506,081 | B2 | 1/2003 | Blanchfield et al. | 439/682 |
| 6,537,111 | B2 | 3/2003 | Brammer et al. | 439/857 |
| 6,554,647 | B1 | 4/2003 | Cohen et al. | 439/607 |
| 6,572,410 | B1 | 6/2003 | Volstorf et al. | 439/608 |
| 6,652,318 | B1 | 11/2003 | Winings et al. | 439/608 |
| 6,692,272 | B2 | 2/2004 | Lemke et al. | 439/108 |
| 6,709,298 | B2 | 3/2004 | Bradley | 439/701 |
| 6,743,057 | B2 | 6/2004 | Davis et al. | 439/701 |
| 6,899,566 | B2 | 5/2005 | Kline et al. | 439/608 |
| 2003/0220021 | A1 | 11/2003 | Whiteman et al. | 439/608 |

FOREIGN PATENT DOCUMENTS

| | | |
|---|---|---|
| JP | 06-236788 | 8/1994 |
| JP | 07-114958 | 5/1995 |
| WO | WO 01/29931 A1 | 4/2001 |
| WO | WO 01/39332 A1 | 5/2001 |

* cited by examiner

RETENTION MEMBER FOR CONNECTOR SYSTEM

CROSS-REFERENCE TO RELATED APPLICATIONS

The instant application is a continuation of U.S. patent application Ser. No. 10/842,397, filed May 10, 2004 now U.S. Pat. No. 7,083,432, which claims benefit of provisional U.S. patent application No. 60/492,901, filed Aug. 6, 2003. The subject matter disclosed in this patent application is related to the subject matter disclosed and claimed in U.S. Pat. No. 6,994,569, which is a continuation-in-part of U.S. patent application Ser. No. 10/294,966, filed Nov. 14, 2002, now U.S. Pat. No. 6,976,886, which is a continuation-in-part of U.S. patent application Ser. Nos. 09/990,794 and 10/155,786, now U.S. Pat. Nos. 6,652,318 and 6,692,272, respectively. The contents of each of the above-referenced U.S. patents and patent applications are herein incorporated by reference in their entireties.

FIELD OF THE INVENTION

The invention relates to electrical connectors. More particularly, the invention relates to a retention member for aligning and stabilizing lead assemblies in an electrical connector.

BACKGROUND OF THE INVENTION

Electrical connectors provide signal connections between electronic devices using signal contacts. Often, the signal contacts are so closely spaced that undesirable cross-talk occurs between nearby signal contacts. Cross-talk occurs when one signal contact induces electrical interference in a nearby signal contact thereby compromising signal integrity. With electronic device miniaturization and high speed electronic communications becoming more prevalent, the reduction of cross-talk becomes a significant factor in connector design.

Thus, as the speed of electronics increases, connectors are desired that are capable of high speed communications. Most connectors focus on shielding to reduce cross-talk, thereby allowing higher speed communication. However, focusing on shielding addresses only one aspect of communication speed.

Therefore, a need exists for a high speed electrical connector design that addresses high speed communications, beyond the use of shielding.

SUMMARY OF THE INVENTION

The invention provides a retention member for aligning and stabilizing one or more insert molded lead assemblies (IMLAs) in an electrical connector. The retention member provides for alignment and stability in the x-, y-, and z-directions. Embodiments of such a retention member are shown in connection with a right angle header connector. The retention member provides stability by maintaining the true positioning of the terminal ends of the contacts. The retention member is expandable in length, and may be sized and shaped to fit a single header assembly or multiple position configurations.

Additional features and advantages of the invention will be made apparent from the following detailed description of illustrative embodiments that proceeds with reference to the accompanying drawings.

BRIEF DESCRIPTION OF THE DRAWINGS

The foregoing summary, as well as the following detailed description of preferred embodiments, is better understood when read in conjunction with the appended drawings. For the purpose of illustrating the invention, there is shown in the drawings exemplary constructions of the invention; however, the invention is not limited to the specific methods and instrumentalities disclosed. In the drawings.

DETAILED DESCRIPTION OF ILLUSTRATIVE EMBODIMENTS

Figure 1A:
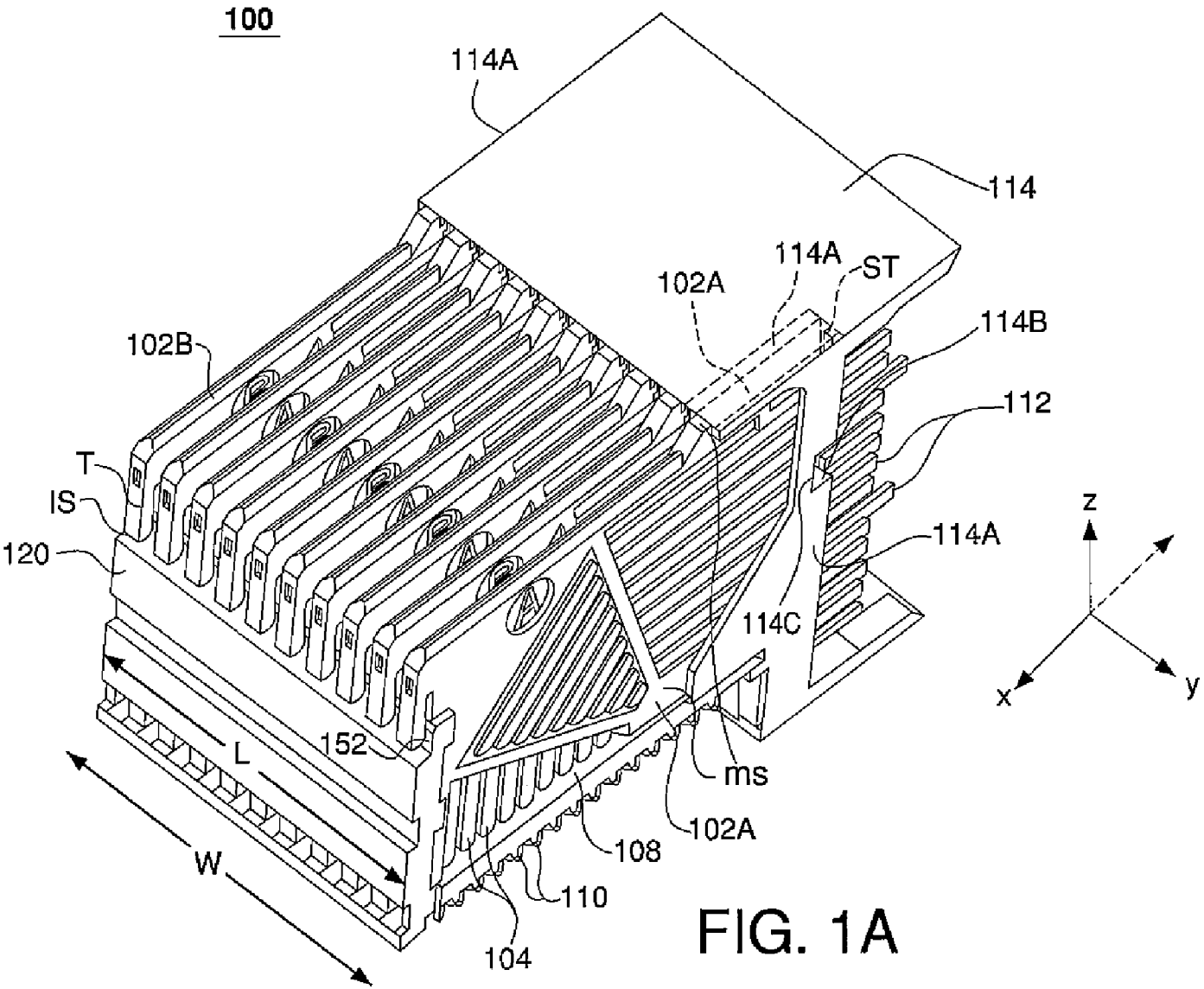
FIGS. 1A and 1B show a right angle header connector assembly including an exemplary retention member and exemplary housing in accordance with the present invention.
Figure 1B:
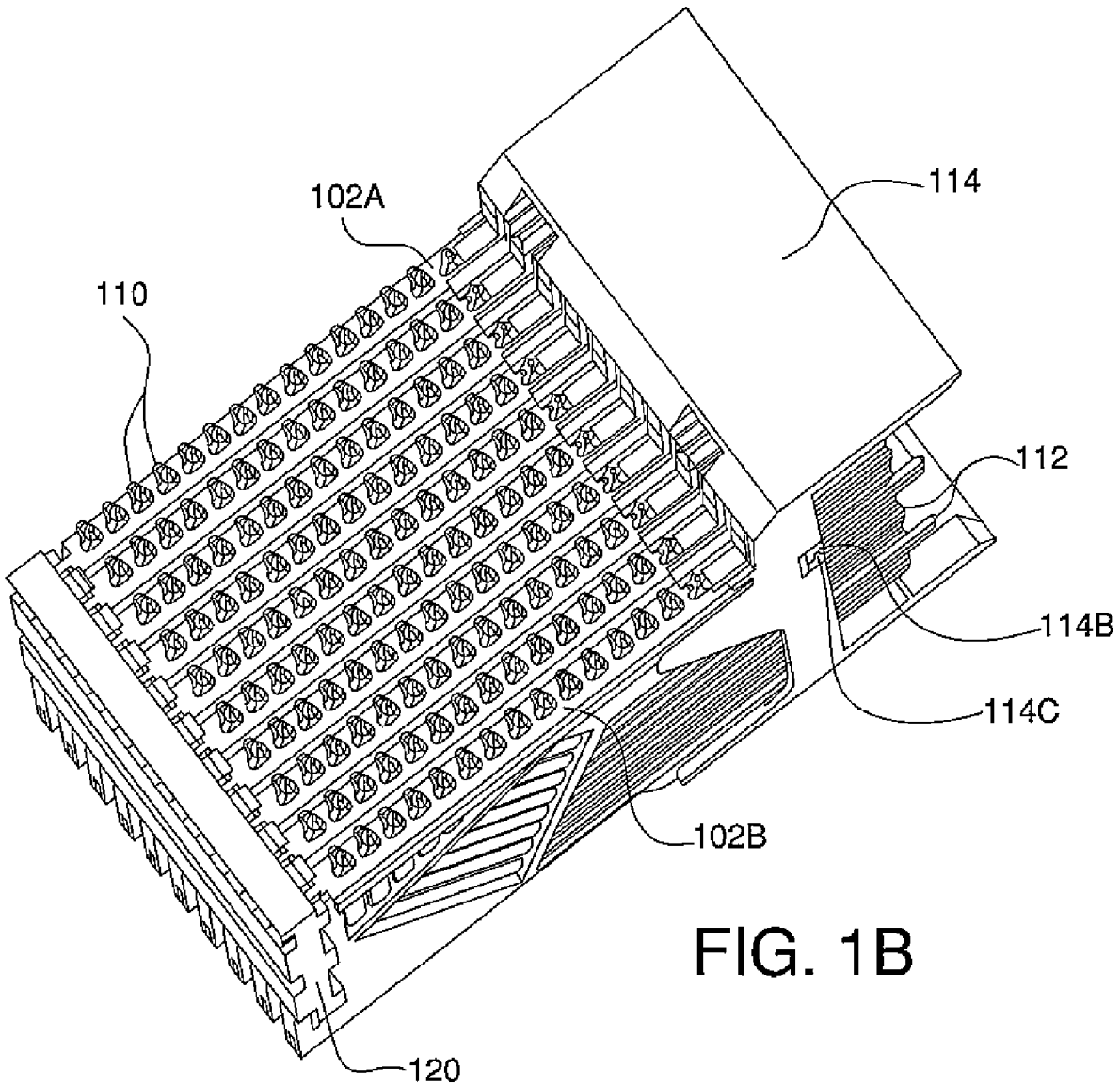

FIGS. 1A and 1B show a right angle header connector assembly 100 comprising an exemplary retention member 120 in accordance with the present invention. As shown, the header assembly 100 may comprise a plurality of insert molded lead assemblies (IMLAs) 102A, 102B, which are described in detail with respect to FIGS. 2A and 2B, respectively. According to an aspect of the invention, each IMLA 102A, 102B may be used, without modification, for single-ended signaling, differential signaling, or a combination of single-ended signaling and differential signaling.

Each IMLA 102A, 102B comprises a plurality of electrically conductive contacts 104, which are arranged in respective linear contact arrays. Though the header assembly 100 shown comprises ten IMLAs, it should be understood that a connector may include any number of IMLAs.

The header assembly 100 includes an electrically insulating lead frame 108 through which the contacts 104 extend. Preferably, the lead frame 108 comprises a dielectric material such as a plastic. According to an aspect of the invention, the lead frame 108 is constructed from as little material as possible and the connector is air-filled to the extent possible. That is, the contacts 104 may be insulated from one another using air as a second dielectric. The use of air provides for a decrease in cross-talk and for a low-weight connector (as compared to a connector that uses a heavier dielectric material throughout, for example).

The contacts 104 comprise terminal ends 110 for engagement with a circuit board. Preferably, the terminal ends 110 are compliant terminal ends, though it should be understood that the terminals ends could be press-fit or any surface-mount or through-mount terminal ends, for example. The contacts also comprise mating ends 112 for engagement with complementary receptacle contacts. As shown, the connector 100 may also comprise a first embodiment housing 114.

The housing 114 comprises a plurality of spaced apart dividing walls 114A, with each dividing wall defining a single notch 114B. The dividing walls 114A are spaced along the housing 114 and are spaced apart far enough to create an opening or slot ST that is large enough for the mating ends 112 of each IMLA 102A, 102B to pass through (approximately 0.9 mm or less, for example), and small enough to prevent the IMLAs 102A, 102B from moving in a first direction (e.g., in the negative x-direction shown in FIG. 1A, i.e., toward the housing 114). In a preferred embodiment, there may also be mechanical stops MS defined by each IMLA to prevent each IMLA from moving in the negative x-direction. Mechanical stop MS can best be seen in FIGS. 2A and 2B. The mechanical stops MS abut the housing 114 when the IMLA 102A, 102B is received in the housing.

Figure 1C:
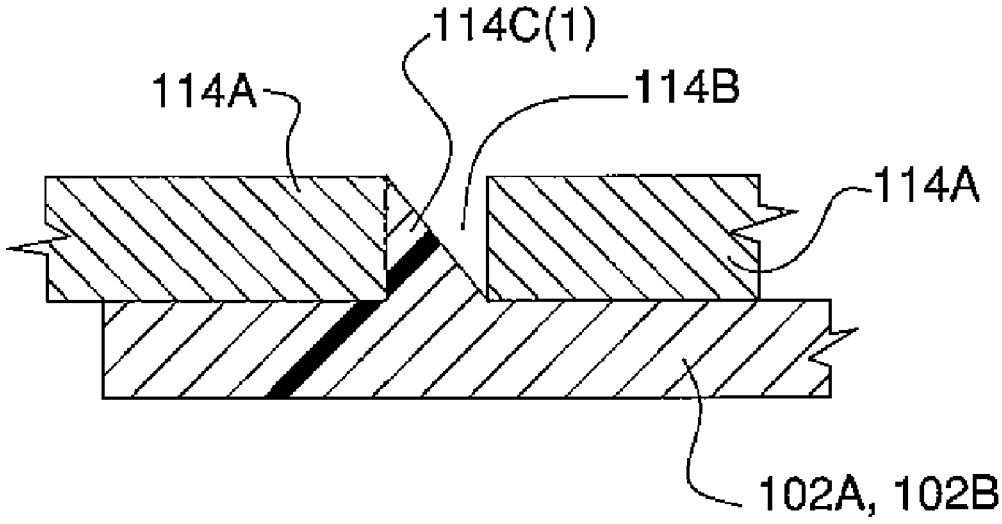
FIGS. 1C and 1D show exemplary protrusions in accordance with the present invention.
Figure 1D:
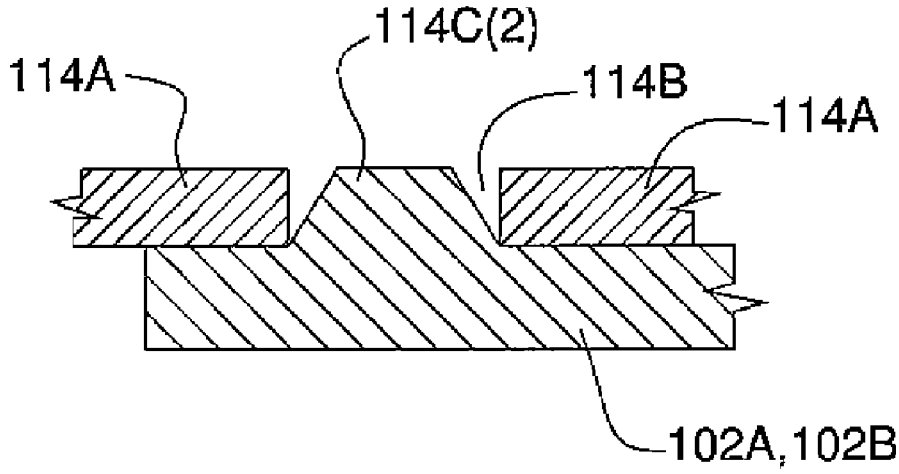

The housing 114 defines one or more notches 114B. Each notch 114B desirably receives a half taper or half ramp protrusion 114C (FIGS. 1C and 1D) on each IMLA 102A, 102B, so that the IMLAs 102A, 102B are locked in the opposite direction (e.g., the IMLAs are generally restrained in the x-direction and the negative x-direction shown in FIG. 1A) after being inserted into the housing 114. The protrusion 114C can best be seen in FIGS. 1C and 1D, which provide a top, cross-section view of an IMLA 102A, 102B received in housing 114 in the vicinity of the protrusion 114C. For added reparability and strengthening, the protrusion 114C can be ramped in either or both of two directions, and thus may have a triangular 114C(1) or trapezoidal 114C(2) cross-section, as shown in FIGS. 1C and 1D, respectively. This design allows individual IMLAs 102A, 102B to be removed in the positive x-direction (i.e., away from the housing) after installation of the IMLA 102A, 102B.

The header assembly 100 also comprises a retention member 120 which provides for alignment and stability of the IMLAs 102A, 102B in the x,y, and z directions. The retention member 120 provides stability by maintaining the true positioning of the terminal ends 110 of the contacts 104. The retention member 120 may have any length, and may be sized and shaped to fit a single header assembly or multiple position configurations. For example, the length L of the retention member 120 may correspond with the width W of a single header assembly, as shown, or may correspond to the combined with of a number of header assemblies disposed adjacent to one another.

An IMLA may have a thickness T of about 1.0 to 1.5 millimeters, for example. An IMLA spacing IS between adjacent IMLAs may be about 0.75–1.0 millimeters. Exemplary configurations include 150 position, for 1.0 inch slot centers, and 120 position, for 0.8 inch slot centers, all without interleaving shields. The IMLAs are stand-alone, which means that the IMLAs may be stacked into any centerline spacing desired for customer density or routing considerations. Examples include, but are not limited to, 2.0 mm, 2.5 mm, 3.0 mm, or 4.0 mm.

Figure 2A:
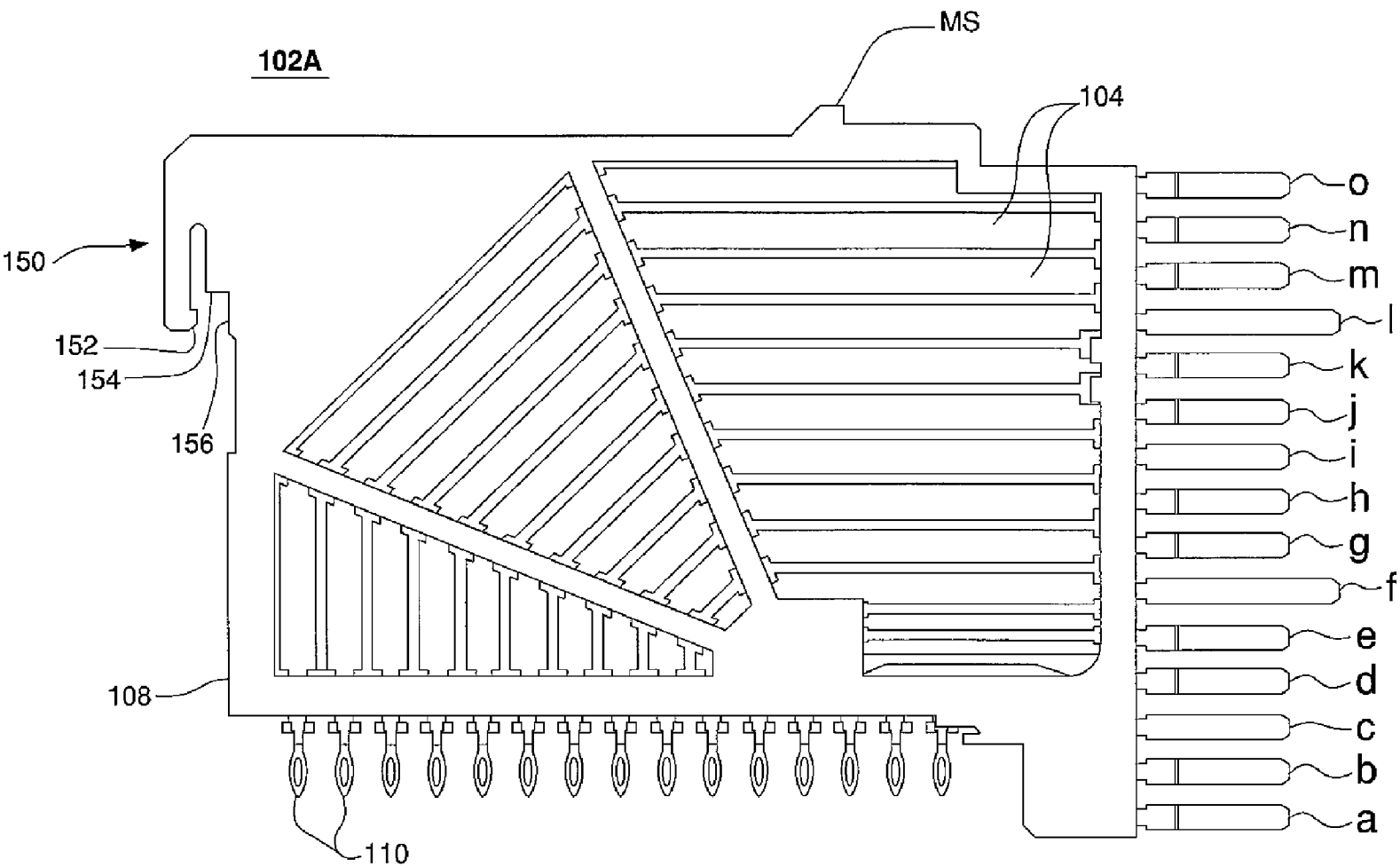
FIGS. 2A and 2B are side views of insert molded lead assemblies in accordance with the present invention.

FIG. 2A is a side view of an IMLA 102A according to the invention. The IMLA 102A comprises a linear contact array of electrically conductive contacts 104, and a lead frame 108 through which the contacts 104 at least partially extend. The contacts 104 may be selectively designated as either ground or signal contacts.

For example, contacts a, b, d, e, g, h, j, k, m, and n may be defined to be signal contacts, while contacts c, f, i, l, and o may be defined to be ground contacts. In such a designation, signal contact pairs a-b, d-e, g-h, j-k, and m-n form differential signal pairs. Alternatively, contacts a, c, e, g, i, k, m, and o for example, may be defined to be signal contacts, while contacts b, d, f, h, j, l, and n may be defined to be ground contacts. In such a designation, signal contacts a, c, e, g, i, k, m, and o form single-ended signal conductors. In another designation, contacts a, c, e, g, h, j, k, m, and n, for example, may be defined to be signal contacts, while contacts b, d, f, i, l, and o may be defined to be ground contacts. In such a designation, signal contacts a, c, and e form single-ended signal conductors, and signal contact pairs g-h, j-k, and m-n form differential signal pairs. Again, it should be understood that, in general, each of the contacts may thus be defined as either a signal contact or a ground contact depending on the requirements of the application.

In each of the designations described above in connection with IMLA 102A, contacts f and l are ground contacts. It should be understood that it may be desirable, though not necessary, for ground contacts to extend further than signal contacts so that the ground contacts make contact before the signal contacts do. Thus, the system may be brought to ground before the signal contacts mate. Because contacts f and l are ground contacts in either designation, the terminal ends of ground contacts f and l may be extended beyond the terminal ends of the other contacts so that the ground contacts g and m mate before any of the signal contacts mate and, still, the IMLA can support either designation without modification.

Figure 2B:
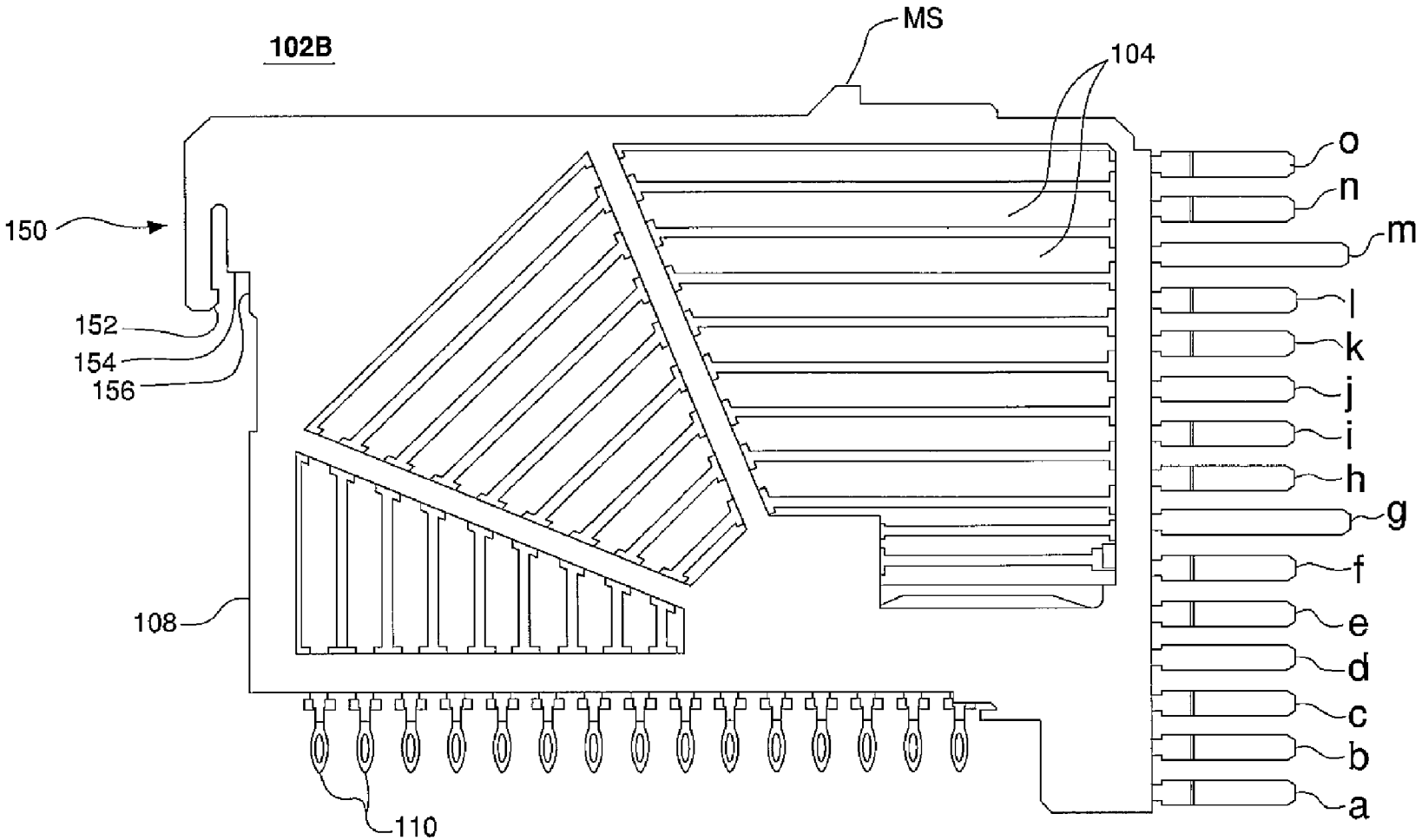

FIG. 2B is a side view of an IMLA 102B that comprises a linear contact array of electrically conductive contacts 104, and a lead frame 108 through which the contacts 104 at least partially extend. Again, the contacts 104 may be selectively designated as either ground or signal contacts.

For example, contacts b, c, e, f, h, i, k, l, n, and o may be defined to be signal contacts, while contacts a, d, g, j, and m may be defined to be ground contacts. In such a designation, signal contact pairs b-c, e-f, h-i, k-l, and n-o form differential signal pairs. Alternatively, contacts b, d, f, h, j, l, and n, for example, may be defined to be signal contacts, while contacts a, c, e, g, i, k, m, and o may be defined to be ground contacts. In such a designation, signal contacts b, d, f, h, j, l, and n form single-ended signal conductors. In another designation, contacts b, c, e, f, h, j, l, and n, for example, may be defined to be signal contacts, while contacts a, d, g, i, k, m, and o may be defined to be ground contacts. In such a designation, signal contact pairs b-c and e-f form differential signal pairs, and signal contacts h, j, l, and n form single-ended signal conductors. It should be understood that, in general, each of the contacts may thus be defined as either a signal contact or a ground contact depending on the requirements of the application.

In each of the designations described above in connection with IMLA 102B, contacts g and m are ground contacts, the terminals ends of which may extend beyond the terminal ends of the other contacts so that the ground contacts g and m mate before any of the signal contacts mate.

Also, though the IMLAs shown in FIGS. 2A and 2B are shown to include fifteen contacts each, it should be understood that an IMLA may include any desired number of contacts. For example, IMLAs having twelve or nine contacts are also contemplated. A connector according to the invention, therefore, may include any number of contacts.

Figure 4A:
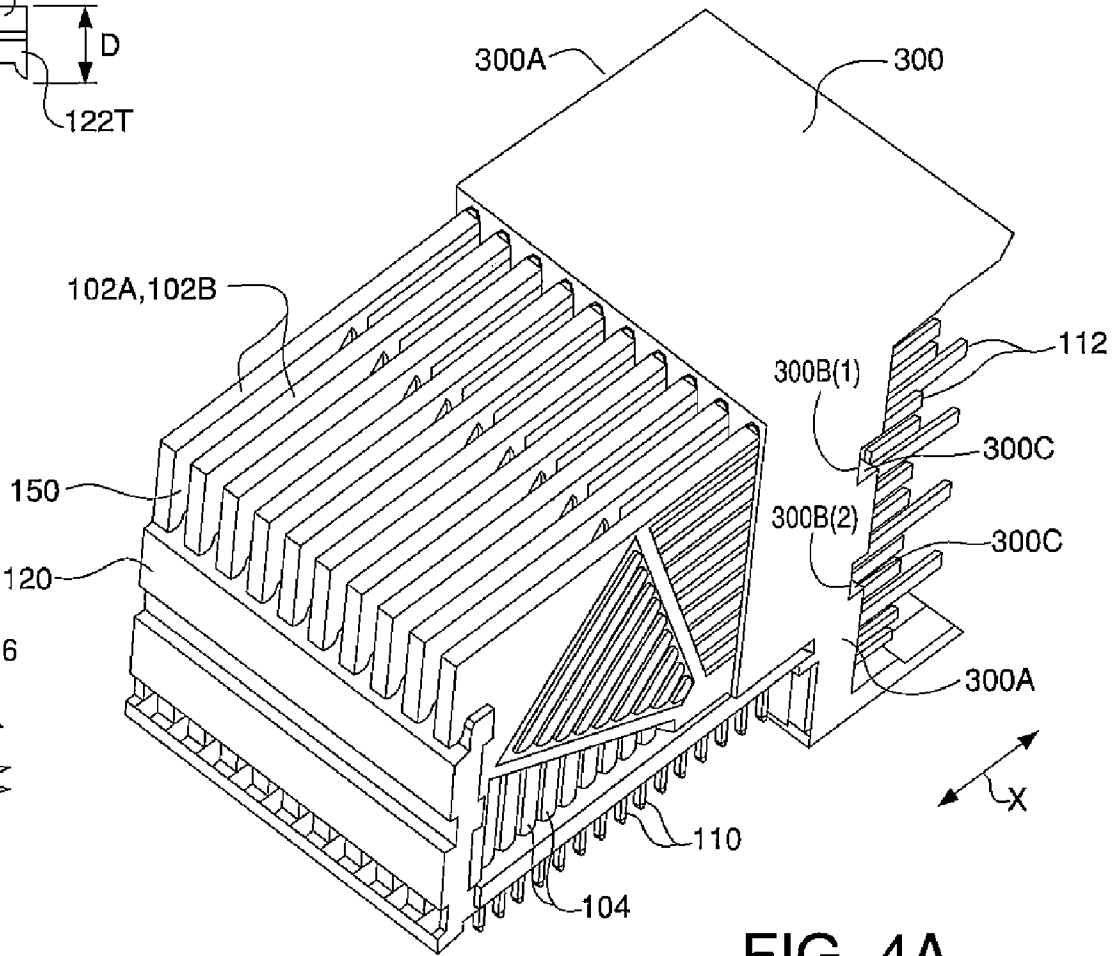
FIGS. 4A and 4B depict a right angle header connector assembly including a another exemplary housing in accordance with the present invention.

Each IMLA 102A, 102B comprises an arm portion 150 having a button end 152. As will be described in detail below, the arm portion 150 may be configured such that the retention member 120 may fit snugly between the arm portion 150 and a first face 156 of the IMLA 102. In this way, the IMLA 102 may be prevented from moving in the negative x-direction with respect to adjacent IMLAs 102 of the electrical connector. The arm portion 150 may be further configured such that a second face 154 of the IMLA 102 may rest on top of the retention member 120. Thus, the IMLA 102 may be designed such that the arm portion 150 straddles the retention member 120. An example is shown in FIG. 4A, where the arm portion 150 of the IMLA 102 extends over the retention member 120. However, as shown in FIG. 1A, for example, the button end 152 acts to push or bias the retainer 120 in the negative x-direction (toward the housing 114).

FIGS. 3A–3D provide isometric, side, front, and top views, respectively, of a retention member according to the invention. As shown, the retention member 120 may be formed, by molding for example, as a single piece of material. The material may be an electrically insulating material, such as a plastic, for example. As an example, the retention member may have a height H of about 14 mm, a length L of about 20 mm, and a depth D of about 2–5 mm. The retention member shown is adapted to retain ten IMLAs in a single connector. Thus, the retention member shown has a length L that corresponds to the typical width of a connector comprising ten IMLAs.

The retention member 120 comprises a wall portion 122 having a first side 122A and a second side 122B. When secured to the connector, the first side 122A of the wall portion 122 abuts the IMLAs. Thus, the wall portion 122 prevents the IMLAs from moving in the x-direction (as shown in FIG. 1A, for example). As described above, the arm portion 150 of each IMLA straddles the top 122T of the wall portion 122. The end 152 of the arm portion 150 abuts the second side 122B of the wall portion 122 of the retention member 120.

The retention member 120 comprises a plurality of protrusions, or nubs, 124 disposed along and extending from the first side 112A of the wall portion 122. The nubs 124 are sized, shaped, and located such that the nubs 124 form a plurality of channels 126. Each channel 126 has a channel spacing CS, which is the distance between adjacent nubs 124 in a given row of nubs 124. The channel spacing CS is chosen such that an IMLA may be received and fit snugly within each channel 126 between adjacent nubs 124. The nubs 124 serve to align the IMLAs truly in the z-direction, and prevent the IMLAs from significantly moving in the y-direction (as shown in FIG. 1A, for example). A rib RB can also be added to the second side 122B of each IMLA to help prevent movement of the IMLAs in the negative z-direction. The button end 152 of arm portion 150 of each IMLA preferably snap fits over a corresponding rib RB.

Each nub 124 has a width w, length 1, and depth d. The width w of each nub 124 is desirably chosen to provide the desired channel spacing CS. In an example embodiment, the width w of each nub is approximately 1 mm, and the channel spacing CS is the same size or slightly larger than the width of each IMLA, so that a clearance fit is obtained between the IMLAs and the retainer. However, other suitable connection methods are also contemplated, such as a dovetail fit between the IMLAs and the retainer (as shown in FIGS. 3D and 3F). The depth d of each nub 124 is desirably chosen to provide sufficient resistance in the y-direction to keep the IMLA from moving in the y-direction. In an example embodiment, the nub depth d is approximately 1 mm. The length 1 of each nub 124 is desirably chosen to minimize the amount of material required to form the retention member 120, yet still provide the desired stabilization and alignment of IMLAs. In an example embodiment, the nub length 1 is approximately 1 mm. It should be understood, however, that the nubs 124 may have any width w, length 1, and depth d desired for a particular application.

Minimizing the amount of material in the retention member 120 contributes to minimizing the weight of the connector. For example, as shown, each nub 124 may have a rounded end 124*e*, shown in FIG. 3E, which serves to reduce the weight of the retention member 120, as well as to facilitate engagement of the retention member 120 with the IMLAs. Though two rows of nubs 124 are shown, it should be understood that a single row of nubs 124 may suffice, or that more than two rows of nubs 124 may be employed.

The retention member 120 also comprises a plurality of seats 128 disposed along and extending from the first side 122A of the wall portion 122. The IMLAs preferably pass between seats 128. Thus, the retention member 120 prevents the IMLAs from moving in the z-direction (as shown in FIG. 1A, for example). The seats 128 are configured to have a seat spacing SS between them, as shown in FIG. 3C, for example. The seat spacing SS may be smaller than the channel spacing CS, as shown, to receive an IMLA having a lead frame 108 that is more narrow in the area between adjacent seats 128 than it is in the area between adjacent nubs 124.

Figure 3A:
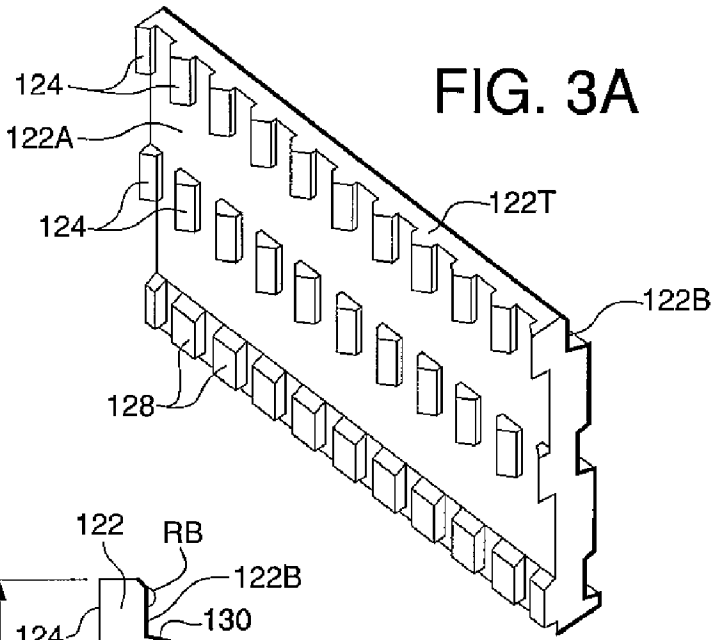
FIGS. 3A–3D are isometric, side, front, and top views, respectively, of the retention member shown in FIGS. 1A and 1B.
Figure 3B:
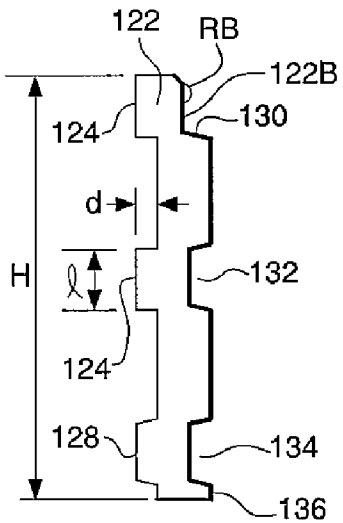
Figure 3C:
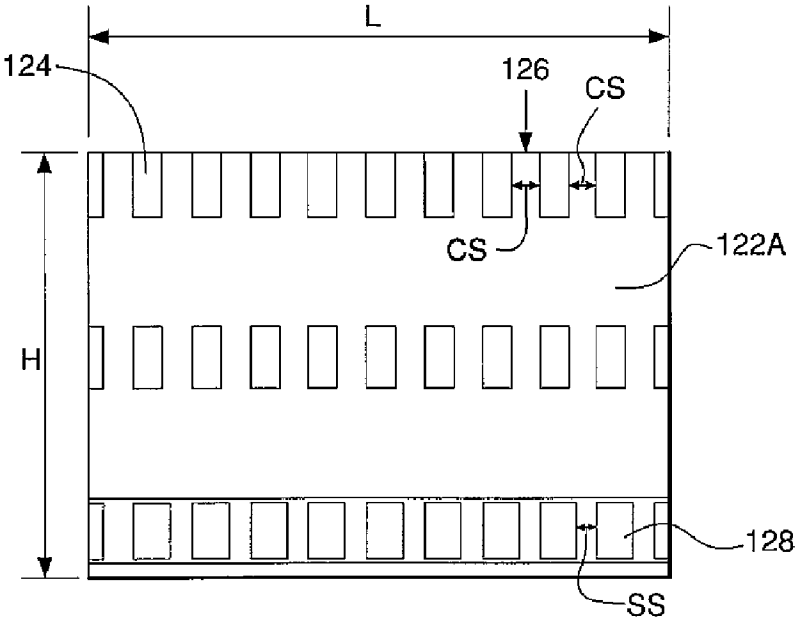
Figure 3D:
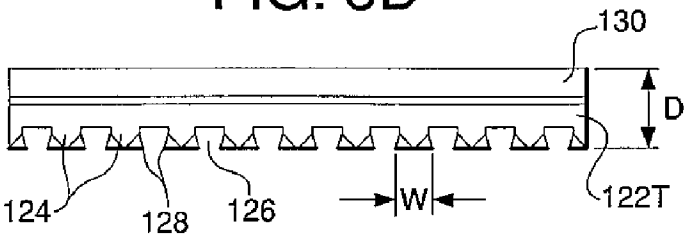
Figure 3E:
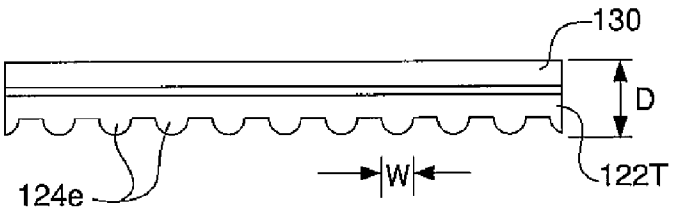
FIG. 3E is a top view of an alternate embodiment of a retention member shown in FIGS. 1A and 1B.
Figure 3F:
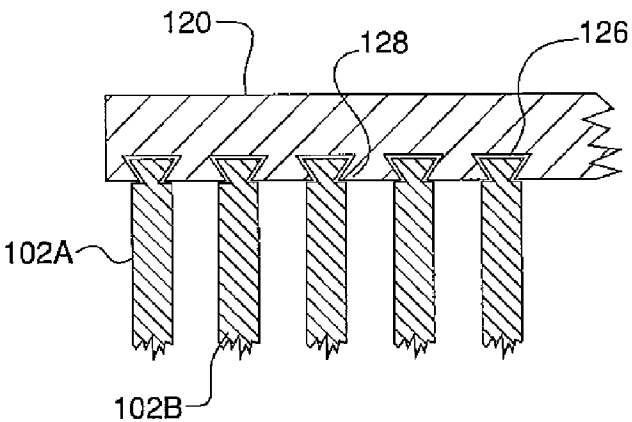
FIG. 3F is a top view of lead frame assemblies forming a dovetail fit with a retention member.

The second side 122B of an exemplary retention member 120 preferably comprises a shoulder 130, a pair of grooves 132, 134, and a foot portion 136, as shown in FIG. 3B, for example.

Figure 4B:
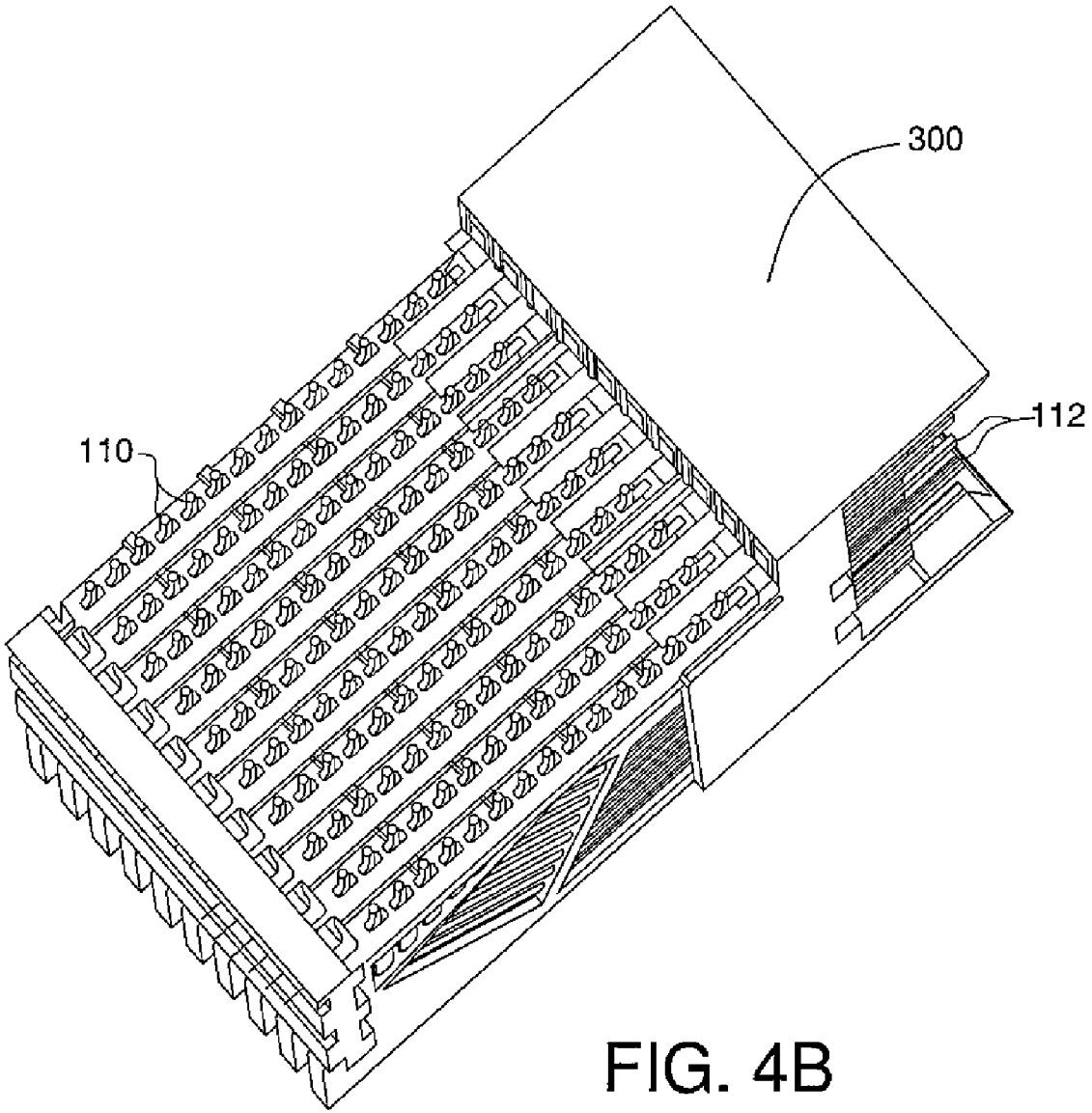

FIGS. 4A and 4B depict an exemplary retention member 120 as part of a right angle header connector assembly including an exemplary housing 300 according to the invention. The housing 300 is similar to the housing 114 described above, and comprises a plurality of spaced apart dividing walls 300A, each of which may include one or more notches 300B(1), 300B(2). The dividing walls 300A are desirably spaced apart far enough to create an opening between them that is large enough for the mating ends 112 of each IMLA 102A, 102B to pass through (e.g., approximately 0.9 mm or less), and small enough to prevent the IMLAs 102A, 102B from moving in the x-direction (i.e., toward the housing 300).

Each notch 300B(1), 300B(2) receives a half taper or half ramp protrusion 300C on each IMLA 102A, 102B, so that the IMLAs 102A, 102B are locked in the negative x-direction (i.e., away from the housing 300) after being inserted into the housing 300. For added repairability and strengthening, the protrusion 300C can be ramped in either or both of two directions, and thus may have a triangular or trapezoidal cross-section, as described above. This design allows individual IMLAs 102A, 102B to be removed in the negative x-direction (i.e., away from the housing 300) after installation of the IMLAs 102A, 102B.

The exemplary housing 300 desirably allows for IMLAs to be attached to the housing 300 in a staggered pattern. For example, one protrusion 300C can engage a first notch 300B(1) and a protrusion 300C on a neighboring IMLA can engage a second notch 300B(2). This arrangement increases stability of the overall connector.

Figure 5:
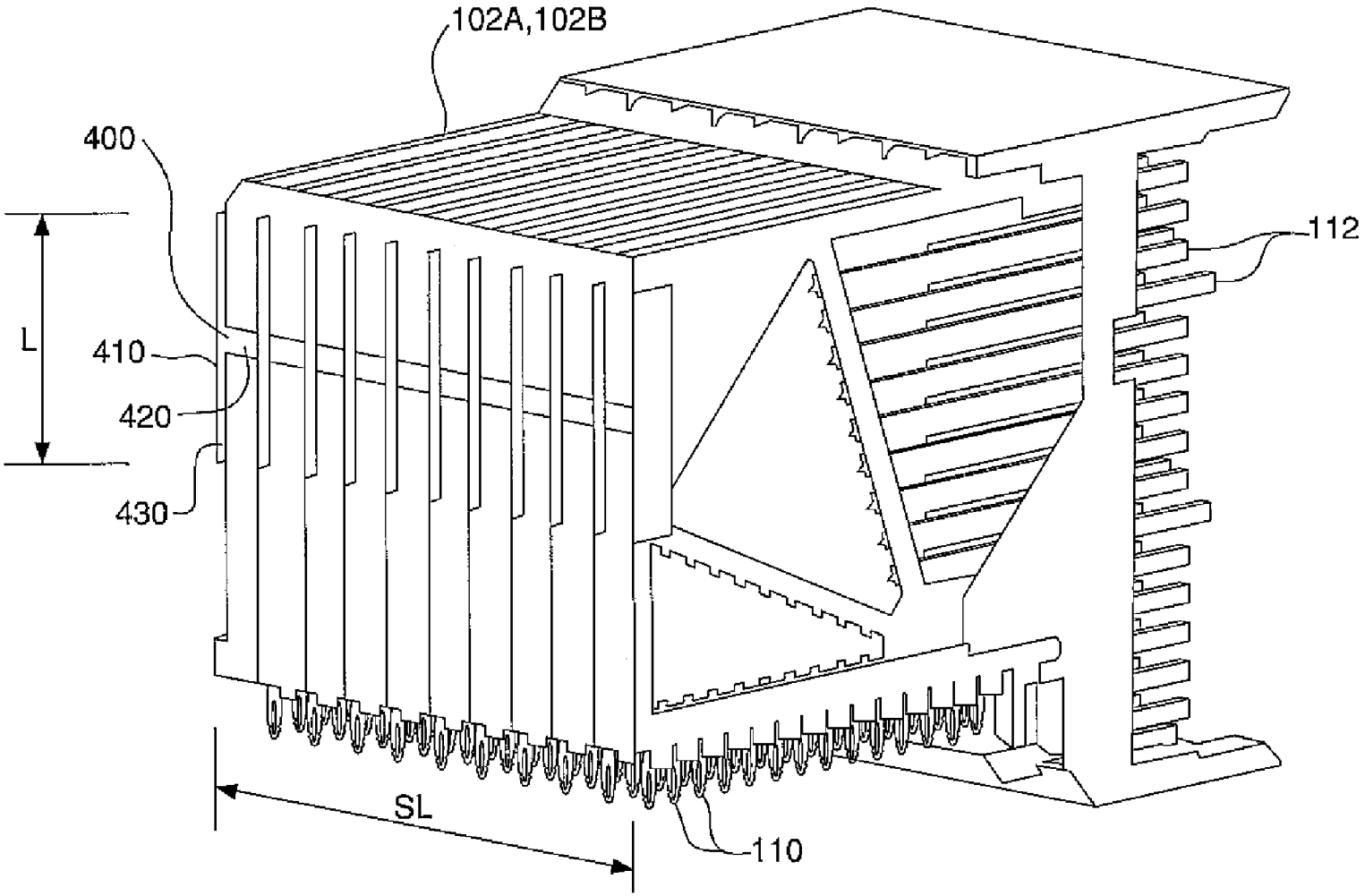
FIG. 5 depicts a right angle header connector assembly including another exemplary retention member in accordance with the present invention.

FIG. 5 shows an alternate embodiment of a retaining member 400 according to the invention. The retaining member 400 is generally in the form of a strip 410 that snap fits into recesses 420 defined by a backbone of each IMLA. Spaced apart spacing members 430 extend approximately 1–2 mm, for example, between the individual IMLAs. The length of the strip 410 and the number of spacing members 430 is desirably dependent on the number of IMLAs. In the example shown in FIG. 5, the overall length SL of the strip 410 may be approximately 19 mm, and the overall length L of each spacing member may be approximately 9 mm.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather should be construed in breadth and scope in accordance with the appended claims.

What is claimed:

1. An electrical connector, comprising:

a connector housing comprising a first dividing wall, the first dividing wall defining a notch;

a first lead frame assembly having a first end that extends into the housing in a first direction, the lead frame assembly being adjacent to the first dividing wall and having a protrusion received in the notch; and a first electrical contact extending through the lead frame assembly, wherein the connector housing is adapted to be removed from the first lead frame assembly.

2. The electrical connector of claim 1, wherein the protrusion received in the notch impedes movement of the lead frame assembly in a direction opposite the first direction.

3. The electrical connector of claim 1, wherein the connector housing is adapted to be removed from the first lead frame assembly by removal of the protrusion from the notch.

4. The electrical connector of claim 1, wherein the connector housing is adapted to be removed from the first lead frame assembly by movement of the housing in the first direction.

5. The electrical connector of claim 1, wherein the protrusion comprises a ramped configuration.

6. The electrical connector of claim 1, wherein the protrusion comprises a triangular cross-section.

7. The electrical connector of claim 1, wherein the protrusion comprises a trapezoidal cross-section.

8. The electrical connector of claim 1, wherein the protrusion comprises a rounded end.

9. An electrical connector, comprising:

a connector housing;

a first lead frame assembly received in the connector housing in a mating direction and extending from the connector housing in a direction opposite the mating direction;

a second lead frame assembly received in the connector housing in the mating direction and extending from the connector housing in the direction opposite the mating direction; and a retention member connected to the first and second lead frame assemblies, wherein the retention member impedes movement of the first lead frame assembly in the mating direction with respect to the second lead frame assembly, wherein the retention member further comprises a first protrusion extending in the mating direction, the first protrusion impeding movement of the first lead frame assembly toward the second lead frame assembly, and wherein the retention member further comprises a second protrusion extending in the mating direction, wherein the first lead frame assembly is received between the first and second protrusions, and wherein each of the first and second protrusions and at least a portion of the first lead frame assembly is shaped such that a dovetail fit is formed when the first lead frame assembly is received between the first and second protrusions.

10. The electrical connector of claim 9, wherein the dovetail fit impedes movement of the first lead frame assembly in the mating direction with respect to the second lead frame assembly.

11. The electrical connector of claim 9, wherein the first protrusion extends between the first and second lead frame assemblies and the retention member impedes movement of the first lead frame assembly in a direction orthogonal to the mating direction.

12. The electrical connector of claim 9, wherein the retention member impedes movement of the first lead frame assembly in a first direction opposite the mating direction, in a second direction toward the second lead frame assembly, in a third direction away from the second lead frame assembly, and in a fourth direction that is orthogonal to each of the first, second, third, and fourth directions.

13. The electrical connector of claim 9, wherein the first lead frame assembly has an arm extending over the retention member that at least in part aids in connecting the retention member to the first lead frame assembly.

14. The electrical connector of claim 9, wherein the retention member is attached to the electrical connector and does not abut the connector housing.

15. An electrical connector, comprising:

a connector housing;

a first lead frame assembly received in the connector housing in a mating direction and extending from the connector housing in a direction opposite the mating direction;

a second lead frame assembly received in the connector housing in the mating direction and extending from the connector housing in the direction opposite the mating direction; and a retention member connected to the first and second lead frame assemblies, wherein the retention member impedes movement of the first lead frame assembly in the mating direction with respect to the second lead frame assembly, wherein the retention member impedes movement of the first lead frame assembly in a first direction opposite the mating direction, in a second direction toward the second lead frame assembly, in a third direction away from the second lead frame assembly, and in a fourth direction that is orthogonal to each of the first, second, third, and fourth directions.

16. The electrical connector of claim 15, wherein the retention member further comprises a first protrusion extending in the mating direction, the first protrusion impeding movement of the first lead frame assembly toward the second lead frame assembly.

17. The electrical connector of claim 16, wherein the retention member further comprises a second protrusion extending in the mating direction, wherein the first lead frame assembly is received between the first and second protrusions, and wherein each of the first and second protrusions and at least a portion of the first lead frame assembly is shaped such that a dovetail fit is formed when the first lead frame assembly is received between the first and second protrusions, and wherein the dovetail fit impedes movement of the first lead frame assembly in the mating direction with respect to the second lead frame assembly.

18. The electrical connector of claim 15, wherein the retention member has a first protrusion extending between the first and second lead frame assemblies and impedes movement of the first lead frame assembly in a direction orthogonal to the mating direction.

19. The electrical connector of claim 15, wherein the first lead frame assembly has an arm extending over the retention member that at least in part aids in connecting the retention member to the first lead frame assembly.

20. The electrical connector of claim 15, wherein the retention member is attached to the electrical connector and does not abut the connector housing.

21. An electrical connector, comprising:

a connector housing;

a first lead frame assembly received in the connector housing in a mating direction and extending from the connector housing in a direction opposite the mating direction;

a second lead frame assembly received in the connector housing in the mating direction and extending from the connector housing in the direction opposite the mating direction; and a retention member connected to the first and second lead frame assemblies, wherein the retention member impedes movement of the first lead frame assembly in the mating direction with respect to the second lead frame assembly, wherein the first lead frame assembly has an arm extending over the retention member that at least in part aids in connecting the retention member to the first lead frame assembly.

22. The electrical connector of claim 21, wherein the retention member further comprises a first protrusion extending in the mating direction, the first protrusion impeding movement of the first lead frame assembly toward the second lead frame assembly.

23. The electrical connector of claim 22, wherein the retention member further comprises a second protrusion extending in the mating direction, wherein the first lead frame assembly is received between the first and second protrusions, and wherein each of the first and second protrusions and at least a portion of the first lead frame assembly is shaped such that a dovetail fit is formed when the first lead frame assembly is received between the first and second protrusions, and wherein the dovetail fit impedes movement of the first lead frame assembly in the mating direction with respect to the second lead frame assembly.

24. The electrical connector of claim 22, wherein the retention member has a first protrusion extending between the first and second lead frame assemblies and impedes movement of the first lead frame assembly in a direction orthogonal to the mating direction.

25. The electrical connector of claim 21, wherein the retention member is attached to the electrical connector and does not abut the connector housing.

* * * * *